United States Patent [19]

Henkelmann

[11] Patent Number: 4,586,365

[45] Date of Patent: May 6, 1986

[54] APPARATUS FOR AUTOMATICALLY TRANSPORTING WORK-PIECES IN A DROP FORGING PRESS

[75] Inventor: Wigand Henkelmann, Leverkusen, Fed. Rep. of Germany

[73] Assignee: Emuco Aktiengesellschaft für Maschinenbau, Leverkusen, Fed. Rep. of Germany

[21] Appl. No.: 669,047

[22] Filed: Nov. 6, 1984

Related U.S. Application Data

[63] Continuation of Ser. No. 400,184, Jul. 20, 1982, abandoned.

[30] Foreign Application Priority Data

Jul. 25, 1981 [DE] Fed. Rep. of Germany ..... 3129482

[51] Int. Cl.[4] ..... B21J 13/08; B21D 43/05

[52] U.S. Cl. ..... 72/405; 72/421; 72/39; 72/45

[58] Field of Search ..... 72/405, 422, 421, 361, 72/41, 43, 39, 45; 10/11 T, 12 T, 72 T, 76 T; 198/621, 744

[56] References Cited

U.S. PATENT DOCUMENTS

| | | | |
|---|---|---|---|
| 1,896,692 | 2/1933 | Berger | 72/405 |
| 1,996,819 | 4/1935 | Dean | 72/405 |
| 2,442,142 | 5/1948 | Nettenstrom | 72/361 |
| 3,011,464 | 12/1961 | Danly et al. | 72/422 |
| 3,138,978 | 6/1964 | Riemenschneider et al. | 72/405 |
| 3,754,667 | 8/1973 | Storch | 198/621 |
| 3,760,957 | 9/1973 | Berger | 72/405 |
| 3,768,632 | 10/1973 | Taniguchi | 198/621 |
| 3,800,583 | 4/1974 | Miller | 72/405 |
| 3,805,582 | 4/1974 | Logan | 72/422 |
| 4,284,670 | 8/1981 | Kole | 72/43 |
| 4,297,869 | 11/1981 | Oldford | 72/405 |
| 4,404,837 | 9/1983 | Allen et al. | 72/405 |

FOREIGN PATENT DOCUMENTS

| | | | |
|---|---|---|---|
| 749010 | 5/1956 | United Kingdom | 72/45 |
| 633657 | 11/1978 | U.S.S.R. | 72/41 |
| 727301 | 4/1980 | U.S.S.R. | 72/45 |

*Primary Examiner*—Daniel C. Crane
*Attorney, Agent, or Firm*—Neil F. Markva

[57] ABSTRACT

In the automatic transport of workpieces in drop-forging presses, the workpiece is moved by a transporting device from one die to the next die in accordance with strokes. The dies are kept clean by blasting and spraying. Two dies are located at each work station and used for the same operating step of the transport mechanism. The transporting includes two respective pairs of workpiece gripping members and has a transport path corresponding to the distance between the different work stations. The output of the press is doubled since it is possible to carry out simultaneous cleaning of the tools by blasting and spraying for each operation of the press.

6 Claims, 5 Drawing Figures

APPARATUS FOR AUTOMATICALLY TRANSPORTING WORK-PIECES IN A DROP FORGING PRESS

This is a continuation of application Ser. No. 400,184 filed July 20, 1982, now abandoned.

FIELD OF THE INVENTION

The invention relates to a process and apparatus for automatically transporting workpieces in drop forging presses such as eccentric presses, wedge-shaped presses and the like. More specifically, the invention relates to transport assembly which moves workpieces from one die to the next with the initial blank workpiece being picked up and transferred around a die partition.

BACKGROUND OF THE INVENTION

Generally, known forging presses include several operating steps to produce forged parts. There are usually four to five different operating steps carried out in one press. An automatic lifting beam transfers workpieces in a known fashion from one work station to the next. All of the workpieces are present in the tool space being transported along simultaneously when each transfer takes place. Gripping members corresponding to the number of operating steps are mounted on the lifting beam for effecting this purpose.

In cold forming presses, the workpieces are fed to the space between the tools of the press with each stroke thereof. The problems of contaminating the tools with scale and the like do not arise in cold forming machines. Contrary to cold forming machines, it is generally necessary to blast the dies of a drop forging press with a cleaning fluid and also to introduce die lubricating materials. The blanks fed to the automatic workpiece transport mechanism are generally introduced in such a way that only each second operation is occupied. The blasting and spraying to effect cleaning of the dies is then controlled so that the unoccupied die in each case is blasted and sprayed. This prior art method produces a certain reduction in the output of the drop forging press and is tolerated because it is necessary to keep the dies clean and lubricated contrary to the use of cold-forming machines.

PURPOSE OF THE INVENTION

The primary object of the invention is to provide operating steps in hot forming, drop forging presses with an automatic workpiece transport in such a way that a blank or workpiece is fed to the tool space of the press with each operating stroke.

SUMMARY OF THE INVENTION

As disclosed and described herein, the drop-forging press includes a plurality of work stations. Two dies are located in each of the work stations. The transport mechanism alternately places the blank or workpiece into only one of the dies in each of the work stations in accordance with each stroke of the press. Thus, there is always one die located in each of the work stations that is free of a workpiece.

The transporting beams in the assembly of the invention pick up the blank and the workpieces between them with gripping members and carry out a longitudinal movement toward and away from each other. As stated, two dies are located at each work station. The transport mechanism includes two respective pairs of gripping members for each work station and has a transport path which corresponds to the distance between the adjacent work stations along the length of the press.

With the method of this invention, the individual operations along the press include preliminary pressing, final pressing, punching, trimming and the like. Each of the individual operations are provided in duplicate in the direction of conveyance of the workpieces. Thus, the output of the press operating with the process of the invention is considerably increased, that is, practically doubled. At the same time, the dies along the path of the transport mechanism are blasted and sprayed with a die lubricating material after each operating step where that particular die is free of a workpiece. The increase in productivity is established because one tool is occupied in each work station, and the other die which is free of workpieces are cleaned and sprayed. Thus, the output of the forging press is effectively doubled.

With the double arrangement of dies in the press, the pressing forces significantly increase which is different than having a single occupation of a die at each work station. One double size forging press costs less in an initial outlay than having two smaller presses thereby saving a significant capital expenditure. At the same time, it is necessary to operate only one larger press which requires only half the operating personnel than two smaller presses. Moreover, one large press requires less space than two smaller automated presses. With twice as many dies in a press, the intervals between changing of tools due to wear is also increased. Thus, stoppage times resulting from tool changes are effectively cut in half with the process and apparatus of this invention.

Another feature of the invention is to have the dies located at each work station being a different symmetrical design. Thus, right and and left hand forged parts may be produced simultaneously in one operation. For example, right hand and left hand stub axles may be produced for a vehicle. Chain side bars for tractor transmissions also require right hand and left hand parts which differ with respect to their symmetrical design. Such parts are usually required in quantities of the same size with one lot of left hand and the other lot of right hand parts. These would have to be provided with different machines if they were being forged individually. However, with the assembly and method of this invention, the right hand and left hand forged parts may be effected in one machine and all at the same time.

A further object of the invention enables the drop-forging press to be easily converted with an appropriate change of tool and adjustment of lifting elements to an operation using a single occupation as in the prior art forging presses. No further modification is necessary to make such a conversion. This is advantageous if larger forged parts are to be processed which would overload the strength of the press with double occupancy by the parts being forged. In some cases, the work stations may include more than two dies which may be used for the same operating step of the forging press.

BRIEF DESCRIPTION OF THE DRAWINGS

Other objects of this invention will appear in the following description and appended claims, reference being made to the accompanying drawings forming a part of the specification wherein like reference characters designate corresponding parts in the several views.

DETAILED DESCRIPTION

Figure 1:
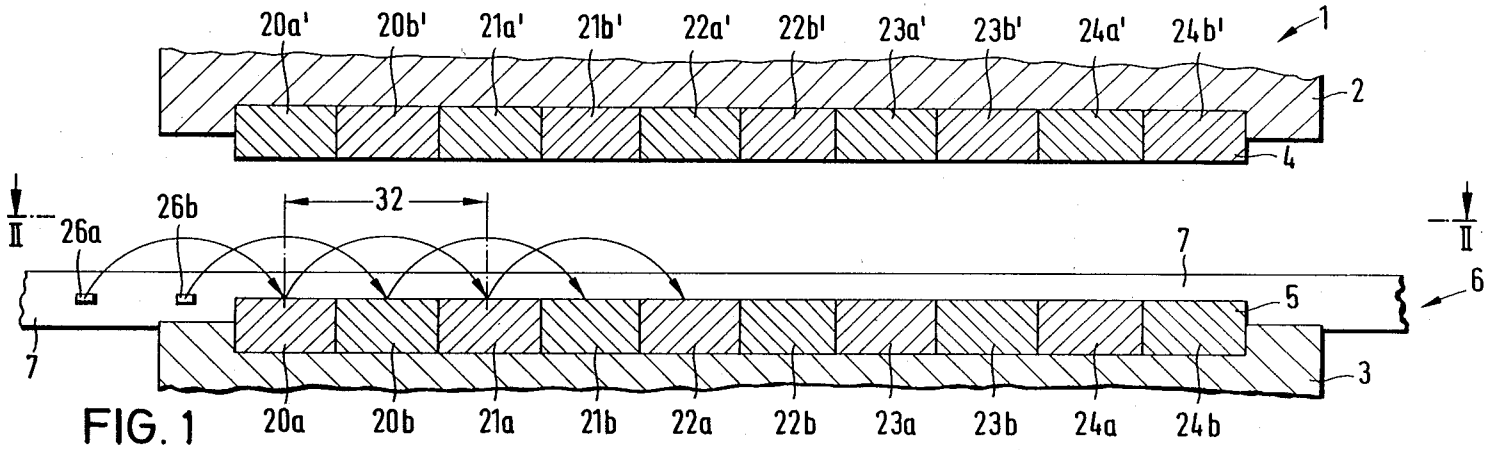
FIG. 1 is a longitudinal sectional view of the tool transport assembly made in accordance with this invention.
Figure 2:
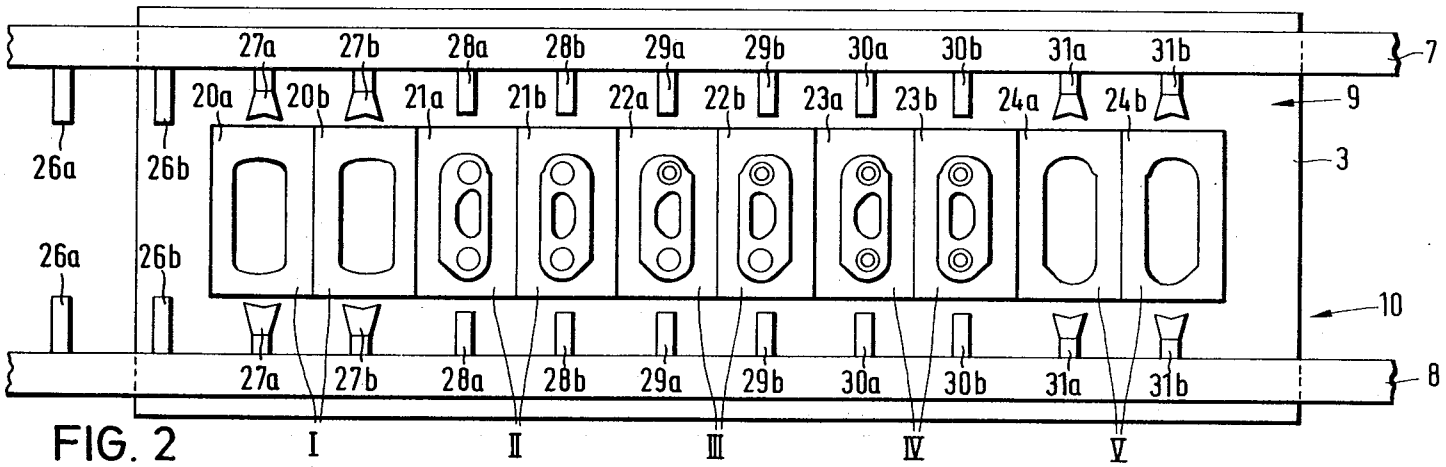
FIG. 2 is a plan view along line II—II of FIG. 1.

Drop-forging press, generally designated 1, includes an upper tool holder 2 and a lower tool holder 3 has upper tools 4 and lower tools 5 secured, respectively, in a known manner. As shown in FIGS. 1 and 2, workpiece transporting device includes transporting or lifting beam 7 and 8 which carry engaging or gripping members 9 and 10 used for gripping the workpieces between them. Transporting beam 7 and 8 are made in accordance with the prior art and effect the automatic workpiece transport run laterally and at the level of the lower die 3. Such prior art transporting beam systems are shown in U.S. Pat. No. 3,138,978 and 3,760,957.

Control mechanisms 12 and 13 are disposed in gear boxes 14 and 15 and drive transport beams 7 and 8. Gear boxes 14 and 15 are mounted on supports 16 and 17 of drop forging press 1 and are connected to each other by a shaft 18 and the transporting beams 7 and 8. The known control of transporting beams 7 and 8 starts from a clamping movement toward each other to grip workpieces with the engaging or gripping pieces 9 and 10. Once the workpieces are gripped, beams 7 and 8 carry out an upward movement followed by a longitudinal movement for transporting the workpiece from a first tool location to the next tool location. The workpiece is then lowered to the die in which the next working operation is to take place where the transport beams 7 and 8 open and deposit the workpiece into the next tool. The return movement of the lifting beam 7 and 8 is parallel to the longitudinal axis of the press and a reverse movement is effected to the starting point of the beams 7 and 8. The pressing stroke of the drop-forging press 1 is effected during the return movement of the beam 7 and 8 to its starting position.

Two tools are located at each working station in press 1. For example, dies 20*a*, 20*b*; 21*a*, 21*b*; 22*a*, 22*b*; 23*a*, 23*b*; and 24*a*, 24*b* are used for the same operating step involving movement along the longitudinal axis of the transport assembly and arranged on the lower tool holder 3. Corresponding dies 20*a'*, 20*b'*; 21*a'*, 21*b'*; 22*a'*, 22*b'*; 23*a'*, 23*b'*; and 24*a'*, 24*b'* are arranged on the upper tool holder 2. Transporting beams 7 and 8 carry two pairs of engaging or gripping members 26*a*, 26*b*; 27*a*, 27*b*; 28*a*, 28*b*; 29*a*, 29*b*; 30*a*, 30*b*; and 31*a*, 31*b* for each working station. The first pairs of engaging or gripping members 26*a*, 26*b* are used to pick up the blank located at an appropriate starting point depending upon the movement of the operating stroke for beams 7 and 8. As shown in FIG. 1, transporting step 32 corresponds to the distance between the various working stations. The operating steps are divided up as follows: I. first preliminary pressing, II. second preliminary pressing, III. final pressing, IV. punching and V. trimming.

Figure 3:
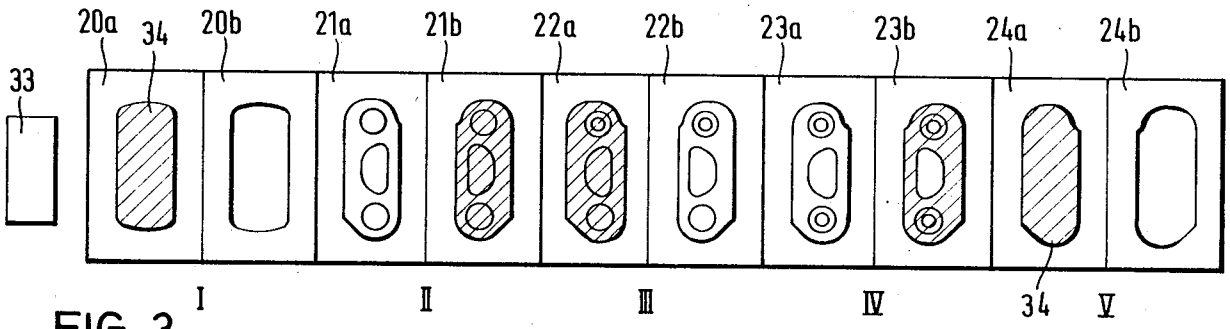
FIG. 3 is a schematic plan view showing the occupation of the doubly arranged tools in a first operating position.
Figure 4:
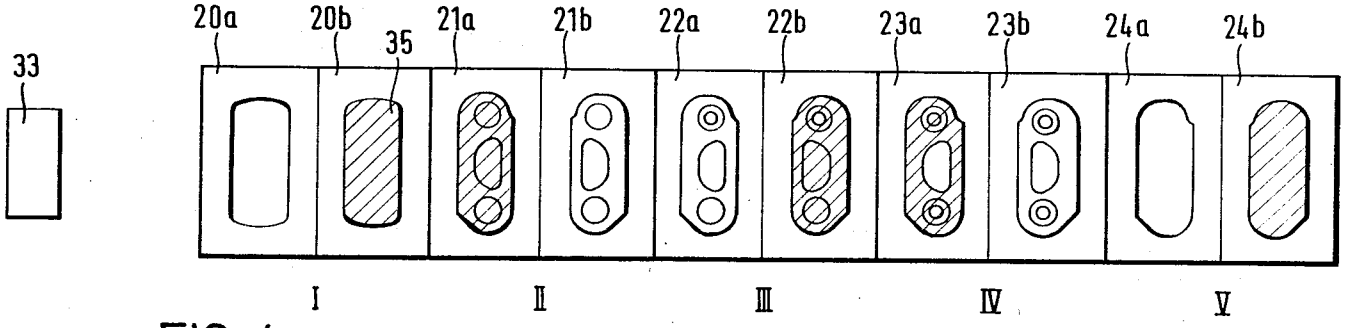
FIG. 4 is a schematic plan view of the occupation of the doubly arranged tools in a second operating position.

FIGS. 3 and 4 show the successive occupation of the tools from one working station to the next. The occupation according to the position shown in FIG. 3 and the occupation according to the position shown in FIG. 4 alternate continually with each other. Blanks 33 are fed to press 1 so that two different adjacent working stations are always occupied and in between times two other adjacent working stations are free. Starting from the position shown in FIG. 3, only one tool of the respective working station is occupied for one stroke while the other tool of the same working station is free of any workpiece with respect to two tools at any one working station. Thus, in FIG. 3 tools 20*a*, 21*b*, 22*a*, 23*b* and 24*a* are shown with workpieces 34. The other tools 20*b*, 21*a*, 22*b*, 23*a* and 24*b* are free of any workpiece.

In the second operating position as shown in FIG. 4, the tool which was free of a workpiece in the first position, is now occupied with the workpiece 35 while the adjacent tool of the same working station has now become free of a workpiece. The occupation of the tools according to the first position shown in FIG. 3 and then according to the position in FIG. 4 alternate continually with each other. Thus, in the working position of FIG. 4, tools 20*b*, 21*a*, 22*b*, 23*a* and 24*b* are occupied with a workpiece 35. Tools 20*a*, 21*b*, 22*a*, 23*b*, and 24*a* are all free of workpieces. As shown in the drawings of FIGS. 2, 3 and 4, the dies at the various working stations I, II, III, IV and V may be of a different design e.g. symmetrical.

The respectively free tools or dies may be cleaned and sprayed in each case during the transfer of the workpieces 34 and 35 along the position as shown in FIGS. 3 and 4. Thus, with the specific manner of transferring blanks 33 into the position of the various dies as shown, the output of press 1 is doubled.

Figure 5:
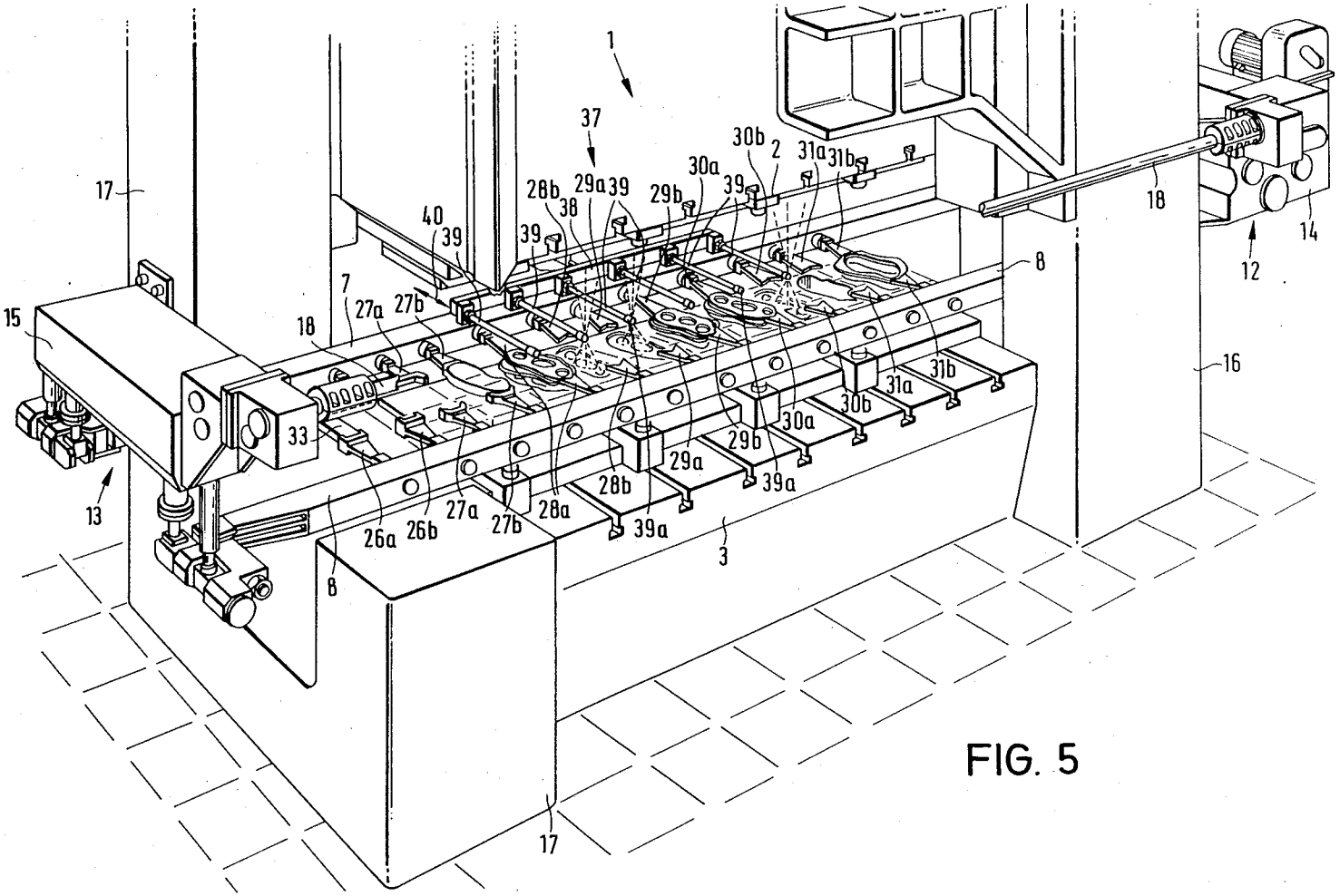
FIG. 5 is a fragmentary, perspective view of a drop-forging press made in accordance with the invention including the tools and the workpiece transport assembly.

The drop-forging press 1 as shown in FIG. 5 illustrates the position of the parts being located in the positions as shown in FIG. 4. A blasting and/or spraying device, generally designated 37, is used to clean and spray the dies which are free of workpieces. As is evident in the drawings, device 37 is located above transport lifting beams 7 and 8 and includes a support 38 carrying tubes 39 having spraying heads 39*a* at each end thereof. As shown, the total number of spraying heads 39*a* on support 38 corresponds to at least the number of work stations each having two tools in press 1. Liquid supply lines (not shown) lead to the tubes 39 for supplying a blasting jet or lubricating means for the dies through the spraying heads 39*a*. Support 38 is mounted to move back and forth in the direction of the double headed arrow 40 which direction is transverse to the transport path of transport lifting beams 7 and 8. Support 38 moves with the tubes 39 and heads 39*a* into the space between the open upper and lower tools of press 1. Thus, with a suitable control, only those heads 39*a* located at a respectively free tool are set into operation to provide the desired blasting jet and/or lubricating means. In other words, spraying heads 39*a* are effective to clean each tool that is free of a workpiece at each work station. The blasting and spraying of the tools which are free of a workpiece is effected while the transporting beams 7 and 8 are moving in their cross or transverse movement to pick up the workpieces and the subsequent upward movement. Upon completion of the blasting and spraying of the tools, support 28 with the tubes 39 and heads 39*a* moves out of the space between the open tools of the press 1. The mechanism for driving and controlling the blasting and spraying device 37 may be constructed in accordance with any known mechanism for moving device 37 into and out of the mold area of the drop-forging press. Examples of such mechanisms are found in the U.S. Pat. Nos. 4,463,587 and 3,633,651 and British Pat. No. 749,010.

While the process and apparatus for automatically transporting workpieces in a drop-forging press have been shown and described in detail, it is obvious that this invention is not to be considered as being limited to the exact form disclosed, and that changes in detail and construction may be made therein within the scope of the invention, without departing from the spirit thereof.

Having thus set forth and disclosed the nature of this invention, what is claimed is:

1. In an assembly for carrying out automatic workpiece transport in a die forging press wherein the workpieces are transported from one tool to the next tool by transporting apparatus including transport lifting beams which carry out a longitudinal movement, a lifting and lowering movement and a transverse movement toward and away from each other with the transport lifting beams having workpiece engaging members which engage the workpieces between the lifting beams, the combination comprising:

(a) means defining a plurality of work stations along the length of the press, (b) two tools located at each work station with each of said tools providing a working point and serving to effect the same working step at each said work station, (c) the transport lifting beams including two respective pairs of workpiece engaging members for each of the work stations with each pair of workpiece engaging members serving adjacent working points, (d) said transport lifting beams having a transport path corresponding to the distance between different work stations, (e) means for blasting and spraying located above the transfer lifting beams and including supply tubes having spraying heads and a support which carries each supply tube with a spraying head to clean each tool of a work station, the total number of spraying heads on said support thereby corresponding to at least the number of work stations each having two tools in the die forging press, (f) the support carrying the spraying heads and supply tubes being reciprocatable in a direction transverse to the transport path of the transport lifting beams, (g) said transport lifting beams being effective to deliver a workpiece to only one of the tools at a single working point at each work station while leaving the other tool at each working station free of the workpiece, (h) said spraying head constituting means to clean each said other tool that is free of a workpiece at each work station.

2. The combination as defined in claim 1, wherein the tools of the same work station are of a different symmetrical design.

3. The combination as defined in claim 1, wherein there are more than two tools at each of the work stations for the same operating step of the press.

4. In an assembly for carrying out automatic workpiece transport in a die forging press wherein the workpieces are transported from one tool to the next tool by transporting means which carry out a longitudinal movement, a lifting and lowering movement, and include workpiece engaging members which engage the workpieces, the combination comprising:

(a) means defining a plurality of work stations along the length of the press, (b) two tools located at each work station with each of said tools providing a working point and serving to effect the same working step at each said work station, (c) the transporting means including two respective pairs of workpiece engaging members for each of the work stations with each pair of workpiece engaging members serving adjacent working points, (d) said transporting means having a transport path corresponding to the distance between different work stations, and (e) means for blasting and spraying including supply tubes having spraying heads and a support which carries each supply tube with a spraying head to clean each tool of a work station, the total number of spraying heads on said support thereby corresponding to at least the number of work stations each having two tools in the die forging press, (f) the support carrying the spraying heads and supply tubes being reciprocatable in a direction transverse to the transport path of the transporting means, (g) said transporting means being effective to deliver a workpiece to only one of the tools at a single working point at each work station while leaving the other tool at each working station free of the workpiece, (h) said spraying head constituting means to clean each said other tool that is free of a workpiece at each work station.

5. The combination as defined in claim 4, wherein the tools of the same work station are of a different symmetrical design.

6. The combination as defined in claim 4, wherein there are more than two tools at each of the work stations for the same operating step of the press.

* * * * *